US006112906A

United States Patent [19]

Worsham

[11] Patent Number: 6,112,906

[45] Date of Patent: Sep. 5, 2000

[54] BALL SEPARATOR SYSTEM

[75] Inventor: Jack W. Worsham, Greensboro, N.C.

[73] Assignee: Intertech Corporation, Greensboro, N.C.

[21] Appl. No.: 09/190,995

[22] Filed: Nov. 12, 1998

[51] Int. Cl.[7] ..... B07B 13/05

[52] U.S. Cl. ..... 209/678; 209/682; 209/677; 209/675

[58] Field of Search ..... 209/678, 677, 209/675, 682, 680, 684, 701, 9, 666, 660; 134/25.4

[56] References Cited

U.S. PATENT DOCUMENTS

| | | | |
|---|---|---|---|
| 626,539 | 6/1899 | Hathorn | 209/678 |
| 854,356 | 5/1907 | Howell et al. | 209/682 |
| 2,314,704 | 5/1943 | Jackson | 209/678 |
| 3,967,821 | 7/1976 | Bagley | 273/11 |
| 4,285,434 | 8/1981 | Schuricht | 209/678 |
| 4,822,106 | 4/1989 | Wilson et al. | 299/9 |
| 5,419,442 | 5/1995 | Wright, Jr. | 209/682 |
| 5,482,565 | 1/1996 | Gutterman et al. | 134/25.4 |
| 5,609,173 | 3/1997 | Hollrock | 134/83 |
| 5,647,089 | 7/1997 | Hollrock | 15/302 |
| 5,669,096 | 9/1997 | Worsham . | |
| 5,673,918 | 10/1997 | Bigari | 273/395 |
| 5,722,543 | 3/1998 | Jarmuzewzki | 209/559 |

*Primary Examiner*—Donald P. Walsh
*Assistant Examiner*—Daniel K. Schlak

[57] ABSTRACT

This invention is directed to a device for separating deformed balls from normal spherical balls prior to washing as is common in the ball pen industry. The device comprises an L-shaped tunnel which defines a slot on its lower surface. The slot feeds into a receptacle positioned below the tunnel. Balls enter under the force of vacuum pressure through an intake opening, striking a first bi-angled deflector plate. Deformed balls will fall through the slot into the receptacle in most cases. However, to increase the likelihood of such an eventuality, the balls then strike a second deflector plate and are sent down the second leg of the L-shaped tunnel. The second leg also defines a slot. By striking the second deflector plate, the ball is reoriented and the likelihood of passing through the slot is increased. Thus, normal balls are left and pass from the L-shaped tunnel out through an output opening and on for conventional washing.

18 Claims, 2 Drawing Sheets

BALL SEPARATOR SYSTEM

BACKGROUND OF THE INVENTION

1. Field of the Invention

This invention pertains to a device which culls, preferably during a washing cycle, deformed balls used in ball playpens.

2. Description of The Prior Art And Objectives of the Invention

Ball playpens are very popular at fast food restaurants and other entertainment centers. These provide safe, fun environments in which children may play. In response to the prevalence of these ball playpens, several attempts have been made to create machines which wash these balls to keep them sanitary. Examples of such devices include U.S. Pat. Nos. 5,647,089; 5,673,918; and my own U.S. Pat. No. 5,669,096.

However, frequently balls become deformed as children crush them or otherwise abuse the balls. These deformed balls are no longer round and may clog ball washing devices or present a risk of injury as the children may scrape themselves on the sharp edges exposed by a split, crushed ball. It is thus desirable to separate or cull these balls from the ball population. U.S. Pat. No. 5,647,089 provides a ball separator formed with a tire and an opposing wall. However, balls frequently come in different sizes and the tire must be changed to accommodate differently sized balls.

It is thus an objective of the present invention to provide a ball separator which culls deformed balls.

It is a further objective of the present invention to provide a ball separator which is easily adapted for use with conventional ball washing apparati.

It is still a further objective of the present invention to provide a ball separator which accommodates the majority of conventionally available balls used in ball playpens.

It is yet a further objective of the present invention to provide a ball separator which accommodates two streams on incoming balls for insertion into a ball washing apparatus.

It is another objective to provide a method of culling deformed balls prior to washing to reduce the risk of fouling the ball washing apparatus with deformed balls.

These and other objectives and advantages will become readily apparent to those skilled in the art upon reference to the following detailed description and accompanying drawing figures.

SUMMARY OF THE INVENTION

The aforedescribed objectives and advantages are realized by providing an intake tube attached to an L-shaped tunnel at one end thereof. At the opposite end of the L-shaped tunnel is an output tube. The L-shaped tunnel is preferably rectilinear and defines a bottom slot, preferably 70 mm wide along its bottom surface. Proximate the intake tube, a bi-angled plate is positioned to deflect balls as they come from the intake tube and enter the L-shaped tunnel. Proximate the corner of the L-shaped tunnel a second plate, this one linear, is positioned to deflect the balls as they strike the corner of the L-shaped tunnel. The slot feeds into a tapered collection chamber below. Vacuum pressure is applied from the output tube throughout the L-shaped tunnel and to the intake tube. Thus, the intake tube acts as a conventional vacuum hose and may be used to scoop balls in the ball playpen for processing purposes and delivery through the L-shaped tunnel.

As the balls enter the L-shaped tunnel from the intake tube, they are deflected by the bi-angled plate and land on the slotted bottom surface of the tube. The slot is narrow in width to prevent properly shaped balls from falling through, but deformed balls with a small diameter will most likely pass therethrough. The vacuum draws the balls around the corner of the L-shaped tunnel where the second plate deflects the ball again. This facilitates great movement and reorientation of the ball relative to the slot, and allows the deformed balls to fall through the slot as the balls pass along the second leg of the L-shaped tunnel. Ideally, only properly shaped balls pass out of the L-shaped tunnel into the output tube for delivery to a ball washing or other apparatus.

DETAILED DESCRIPTION OF THE PREFERRED EMBODIMENTS AND OPERATION OF THE INVENTION

Figure 1:
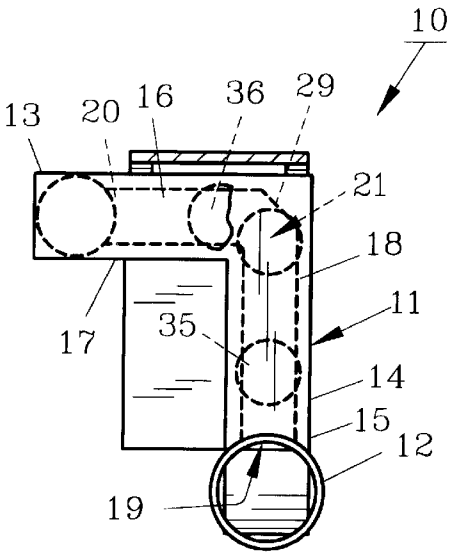
FIG. 1 shows a top view of the preferred embodiment of the present invention.
Figure 2:
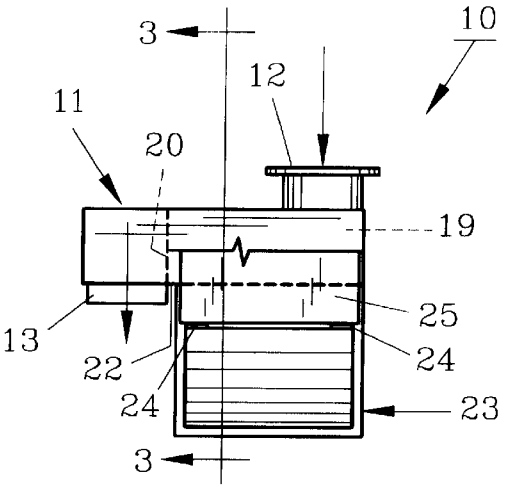
FIG. 2 illustrates a front view of the device of FIG. 1.
Figure 4:
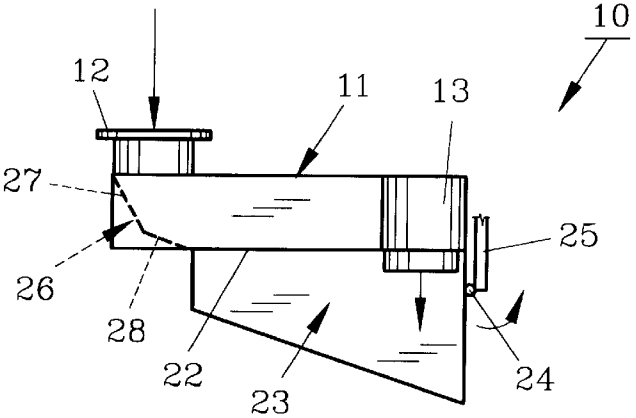
FIG. 4 features a side view of the device of FIG. 1.

Turning now to the drawings, specifically FIG. 1 shows a top view of ball separator 10 which comprises L-shaped tunnel 11 fed by intake tube 12 and exited via output tube 13. L-shaped tunnel includes first leg 14 with distal end 15 and second leg 16 with distal end 17. Distal ends 15 and 17 are separated by corner 18. First leg 14 defines intake opening 19, while second leg 16 defines output opening 20. L-shaped tunnel 11 defines slot 21 (shown ghosted in FIG. 1) along the length of bottom surface 22 (FIGS. 2 and 4). Most conventional playpen balls are at least 72 mm in diameter, although they do range up to 80 mm in diameter. Slot 21 is preferably 70 mm wide and L-shaped tunnel is preferably 85 mm wide. Natural, spherical balls, such as ball 35 will not fit through slot 21, however, deformed balls, such as ball 36 will pass therethrough by the operation of gravity when properly positioned.

Figure 3:
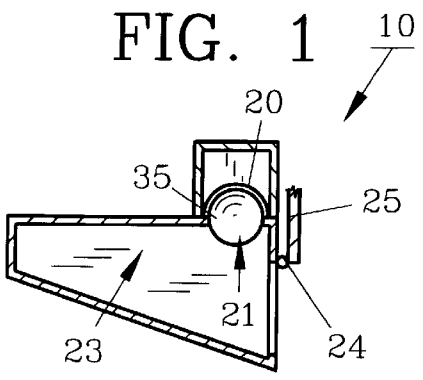
FIG. 3 demonstrates a cross-sectional view along lines 3—3 of FIG. 2.

As seen in FIGS. 2 and 4, receptacle 23 is positioned below L-shaped tunnel 11, and is preferably tapered. Hinges 24 allow door 25 to be opened so that deformed balls may be manually removed therefrom. While not shown, a elastomeric gasket or ring surrounds door 25 so that when door 25 is closed air does not pass therethrough. First deflection plate 26 is seen in dotted fashion in FIG. 4. First deflection plate 26 comprises first portion 27 and second portion 28, which together form a bi-angled deflection plate. As balls enter L-shaped tunnel 11 from intake tube 12, these balls pass through intake opening 19 and strike first deflection plate 26 (usually twice) which slows the velocity of the balls and redirects the balls along first leg 14 of L-shaped tunnel 11. Second deflection plate 29 is positioned in corner 18 and serves much the same purpose, although it is preferably planar and not bi-angled. It further slows the balls and directs them down second leg 16. Deformed ball 36's orientation is thus changed by L-shaped tunnel 11 and deflection plates 26 and 29 thereby greatly increasing the likelihood that it will fall through slot 21 (FIG. 3).

Figure 6:
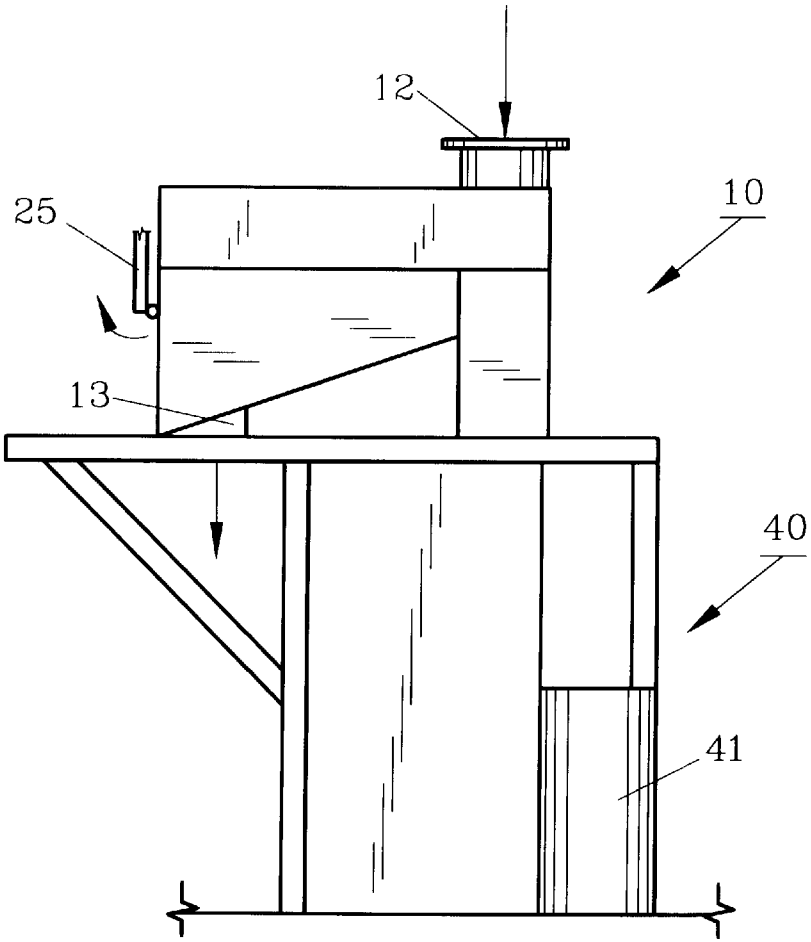
FIG. 6 depicts the device of FIG. 1 mounted on a ball washer.

As seen in FIG. 6, ball separator 10 is best used on a conventional ball washing machine, such as ball washing machine 40 identical to that disclosed in U.S. Pat. No. 5,669,096. Vacuum pressure is created by blower 41 and drawn through output tube 13. This creates a vacuum in ball separator 10 and further in intake tube 12. Intake tube 12 can be used as a wand such as is disclosed in U.S. Pat. No. 5,647,089, as a target such as is seen in U.S. Pat. No. 5,673,918, or other appropriate collection device. In either event, balls 35 and deformed balls 36 are drawn through tube 12 to ball separator 10 and then to output tube 13 for delivery to ball washer 40.

Figure 5:
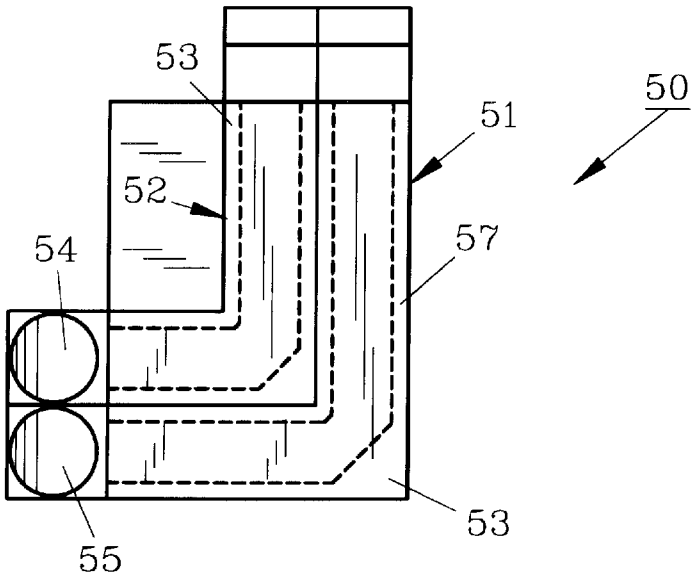
FIG. 5 pictures a top view of an alternate two tunnel device for use with multiple ball playpens.

An alternate embodiment of a ball separator is seen in FIG. 5, where ball separator 50 includes two L-shaped tunnels 51 and 52, which share common receptacle 53. Ball separator 50 would be used when two ball pits are being cleaned at the same time. Output tubes 54 and 55 would feed into separate washing channels of a two channel ball washing machine (not shown). In practice, ball separator 50 operates identically to ball separator 10, but with a plurality of L-shaped tunnels.

The preferred method of using ball separator 10 comprises drawing balls 35 and 36 through intake tube 12 (FIG. 1) to intake opening 19 by means of vacuum pressure. Balls 35 and 36 are then deflected by first bi-angled deflection plate 26 and into first leg 14 of L-shaped tunnel 11. Gravity acts on some portion of deformed balls 36 and draws them into receptacle 23 through slot 21. The vacuum draws spherical balls 35 and the remaining portion of deformed balls 36 towards second deflection plate 29, where they are deflected into second leg 16. The orientation of balls 35 and 36 is changed and the balls 35 travel down second leg 16 while remaining deformed balls 36 fall through operation of gravity through slot 21 into receptacle 23 where they remain until door 25 is lifted and balls 36 are removed. Spherical balls 35 then pass through output opening 20 and into output tube 13 onto a ball washer or other apparatus.

The preceding recitation is provided as an example of the preferred embodiments and is not meant to limit the nature of scope of the present invention or appended claims.

I claim:

1. An apparatus to separate deformed balls from spherical balls in a vacuum system, said apparatus comprising:

a) an enclosed L-shaped tunnel forming a ball passage within, said L-shaped tunnel defining a slot; and b) a closed receptacle, said receptacle positioned below said slot and receiving deformed balls that pass therethrough by the operation of gravity.

2. The apparatus of claim 1 further comprising a deflection plate, said deflection plate proximate one end of said L-shaped tunnel.

3. The apparatus of claim 1 further comprising a deflection plate, said deflection plate proximate the bend of said L-shaped tunnel.

4. The apparatus of claim 2 wherein said deflection plate is bi-angled.

5. The apparatus of claim 1 wherein said L-shaped tunnel further defines an intake opening.

6. The apparatus of claim 1 wherein said L-shaped tunnel further defines an output opening.

7. In an vacuum operated ball washing apparatus, the improvement comprising a deformed ball separator, said ball separator comprising:

a) an enclosed L-shaped tunnel forming a ball passage within, said L-shaped tunnel defining a slot; and b) a closed receptacle, said receptacle positioned below said slot and receiving deformed balls that pass therethrough by the operation of gravity.

8. The apparatus of claim 7 further comprising a deflection plate, said deflection plate proximate one end of said L-shaped tunnel.

9. The apparatus of claim 7 further comprising a deflection plate, said deflection plate proximate the bend of said L-shaped tunnel.

10. The apparatus of claim 8 wherein said deflection plate is bi-angled.

11. The apparatus of claim 7 wherein said L-shaped tunnel further defines an intake opening.

12. The apparatus of claim 7 wherein said L-shaped tunnel further defines an output opening.

13. A method of separating deformed balls from spherical balls in a vacuum system, said method comprising the steps of:

a) feeding both deformed balls and spherical balls into an enclosed L-shaped tunnel;

b) allowing deformed balls to pass through a slot on the bottom surface of said L-shaped tunnel into a closed receptacle; and c) forcing the spherical balls through an output opening.

14. The method of claim 13 further comprising the step of collecting the deformed balls in a receptacle positioned below the slot.

15. The method of claim 14 further comprising the step of removing the deformed balls in the receptacle by opening a hinged door.

16. The method of claim 13 further comprising the step of deflecting the balls with an angled plate at the corner of the L-shaped tunnel.

17. The method of claim 13 further comprising the step of deflecting the balls with a plate at an intake opening of the L-shaped tunnel.

18. The method of claim 17 wherein deflecting the balls with a plate at an intake opening of the L-shaped tunnel comprises the step of deflecting the balls with a bi-angled plate.

* * * * *